US007314084B2

(12) United States Patent
Rodrigues et al.

(10) Patent No.: US 7,314,084 B2
(45) Date of Patent: Jan. 1, 2008

(54) SUBSEA PUMPING MODULE SYSTEM AND INSTALLATION METHOD

(75) Inventors: Roberto Rodrigues, Rio de Janeiro (BR); João Siqueira de Matos, Rio de Janeiro (BR); Carlos Alberto Giacomim Pereira, Vitória (BR); Jackson Burjack Farias, Vila Velha (BR); Robson Soares Junior, Macaé (BR)

(73) Assignee: Petroleo Brasileiro S.A. - Petrobras, Rio de Janeiro (BR)

( * ) Notice: Subject to any disclaimer, the term of this patent is extended or adjusted under 35 U.S.C. 154(b) by 341 days.

(21) Appl. No.: 10/982,848

(22) Filed: Nov. 8, 2004

(65) Prior Publication Data

US 2005/0217857 A1 Oct. 6, 2005

(30) Foreign Application Priority Data

Apr. 1, 2004 (BR) ..... 0400926

(51) Int. Cl.
*E21B 29/12* (2006.01)

(52) U.S. Cl. ..... 166/344; 166/349; 166/381

(58) Field of Classification Search ..... 166/341, 166/339, 368, 338, 342, 343, 381, 77.51, 166/85.1, 344, 349, 241.6
See application file for complete search history.

(56) References Cited

U.S. PATENT DOCUMENTS 4,194,857 A * 3/1980 Chateau et al. ..... 405/203
4,661,016 A * 4/1987 Baugh et al. ..... 405/169
4,673,313 A * 6/1987 Baugh et al. ..... 405/224.3
4,848,475 A * 7/1989 Dean et al. ..... 166/357
4,900,433 A 2/1990 Dean et al.
5,005,650 A * 4/1991 Hopper ..... 166/339
5,280,766 A 1/1994 Mohn
5,474,601 A * 12/1995 Choi ..... 96/182
6,036,749 A 3/2000 Ribeiro et al.
6,408,947 B1 * 6/2002 Cunningham et al. ..... 166/339
6,412,562 B1 * 7/2002 Shaw ..... 166/335
6,497,287 B1 12/2002 Podio et al.
6,688,392 B2 2/2004 Shaw
6,702,027 B2 * 3/2004 Olson et al. ..... 166/369
6,832,874 B2 * 12/2004 Appleford et al. ..... 405/189
7,150,325 B2 * 12/2006 Ireland et al. ..... 166/366

* cited by examiner

*Primary Examiner*—Thomas A Beach
(74) *Attorney, Agent, or Firm*—Sughrue Mion, PLLC

(57) ABSTRACT

The present invention contemplates a system comprising a pumping module coupled to an intermediate flow inlet (IFI) wherein said IFI is coupled to a base structure disposed on the flow line that routes production from one or more oil wells, allowing for the quick and easy installation or recovery of a subsea pumping module by cable from an inexpensive vessel. The present invention also allows for the hydraulic isolation of the subsea pumping module by means of on-off valves on the IFI whereby the pumping module can be easily installed or removed without causing underwater oil spills. Sealing of the connection is of the metal-metal type. It is also possible to pass a pig through the present system for clearing the flow lines.

24 Claims, 8 Drawing Sheets

SUBSEA PUMPING MODULE SYSTEM AND INSTALLATION METHOD

FIELD OF INVENTION

The present invention relates to subsea equipment installed on the seafloor and intended for oil production, and which can also be applied to water injection systems in hydrocarbon reservoirs. More specifically, the present invention relates to pumping modules coupled to an intermediate flow inlet on a subsea base, whereby said modules can be installed as well as recovered by cable. The present invention further relates to the method for installing said pumping module.

BACKGROUND OF THE INVENTION

Offshore oil production requires that subsea wells be drilled and that equipment such as Christmas tree manifolds, oil flow lines, gas injection lines and water injection lines be installed between the wellheads and the processing facilities. These processing facilities may be located on a vessel, platform, or even on land.

Christmas tree manifolds are assemblies of connectors and valves installed at the top of an oil wellhead and are used to block (open and close) and route the flow of fluids produced or injected.

There are two types of wet Christmas tree (WCT) manifolds, depending on how the valves are arranged with regard to the production column hanger inside the well: horizontal and vertical (which is conventional). In some cases, mainly with a vertical wet Christmas tree manifold, additional equipment known as a production adaptor base (PAB) is employed between the WCT and the wellhead. The production adaptor base is mainly intended to support the oil-production and gas-injection lines, as well as the production column. In the latter case, the tubing hanger is attached to the production adaptor base rather than to the WCT. Flowlines supported by the production adaptor base are connected to the wet Christmas tree, which is in turn connected to the well bottom by the production column.

Inasmuch as producing wells are located at some distance from the processing facilities, sufficient pressure must be maintained at the wellhead so that fluids can flow to the facilities at a reasonable flow rate so as to make the project economically feasible.

Various lifting methods are used to boost flow from the wellhead to the processing facilities. One such method uses pumps, for example centrifugal pumps known as electrical submersible pumps (ESP). Installed at the bottom of oil-producing wells, they are generally driven by an electric motor.

Once the ESP, production column and wet Christmas tree have been installed at the well, maintenance performed on the ESP increases operating costs and risks, involving the equipment as well as the environment.

From time to time it becomes necessary to perform maintenance or repairs on the ESP installed in the well. Removal of an ESP from the subsea well requires an interruption (loss) of oil production for several days, along with the use of additional equipment and vessels equipped with a rig so that the ESP and production column can be removed, resulting in higher production costs.

U.S. Pat. No. 6,497,287 describes how an electrical submersible pump is typically used in the production of offshore oil.

Furthermore, U.S. Pat. No. 5,280,766 shows that an ESP can be installed or recovered from the well bottom without removing the subsea Christmas tree, through flexible steel tubing known as "coil tubing" or "flexi-tubo."

Based on Applicant's Brazilian Application PI 0301255-7, herein incorporated in full as a reference, it is known that it is possible to use a pumping module installed and retrieved by cable from a nonspecialized vessel. Such a module is comprised of a closed tubular body and a hydraulic connector, whereby said connector is coupled to the mandrel of an intermediate flow inlet (IFI), thus establishing a hydraulic communication between the pumping module and the cavities (holes) in said mandrel, i.e., for pump suction and discharge. Such an application has the disadvantage of requiring changes in the PAB-WCT assembly that alter the manufacturing standard by increasing the weight, size and cost of said assembly. Moreover, when the pumping module is mounted vertically, its upper end extends above the WCT, hampering light activity at these wells due to the need to remove this module to avoid the risk that the completing riser-blow out preventer (BOP) will strike the module during connection for reentry into the well. Another drawback of this system is that it cannot be easily applied to existing wells owing to the need to change the production adaptor base (PAB), in other words, re-completing the well with removal of the production column is required.

U.S. Pat. Nos. 4,900,433 and 6,036,749 show a vertical oil separator system with a pump similar to an ESP, wherein a separator-pump assembly is installed in a dummy well built for the sole purpose of holding the separation-pumping assembly and whose pump is similar to an ESP with rather slender geometry, i.e., thin and long, designed preferably to operate in the vertical position.

Moreover, U.S. Pat. No. 6,688,392 shows that it is possible to install a motor pump assembly, similar to an ESP, hydraulically linked to a dummy well. Nevertheless, this solution presents a number of drawbacks: the dummy well is hydraulically linked to the flow from the oil well, and operates under oil pressure. When the liner of the dummy well corrodes, maintenance becomes difficult because the liner is buried in the seabed and cannot be recovered. Although there is a reference to a bypass, the proposed geometry has no provision or possibility for a pig (i.e., a flow line cleaning device) to pass, a basic necessity to ensure oil well flow. Nor is another lifting method described to maintain production continuity in case the proposed pumping system fails. The dummy well is of conventional construction, i.e., drilled and cemented. In addition, the pump installation method requires a vessel with a coil tubing unit. Connection of the proposed pumping system has no metal-metal seal.

Despite the above developments, there is still a need in the state of art for a cable-based system and method for installing and recovering a centrifugal pumping module that does not have the drawbacks described above.

SUMMARY OF THE INVENTION

The present invention overcomes the above drawbacks in the state of art by constructing a pumping module associated with an installation or recovery method by cable, with said module supported by and connected to a base structure on the seabed at a safe distance from the WCT and without interfering with well reentry operations.

Said base structure may simply rest on the seabed, or it may be supported and jacketed (coupled) by a hollow pile, or merely supported on a foundation comprising a pile.

The configuration of a pumping module installed in a hollow pile (which is the preferred embodiment of the present invention) driven into the seabed especially for this purpose, differs from the current state of art whereby a distinguishing feature of the present invention is that the sole purpose of said hollow pile is to support and hold the vertical pumping module, and is not part of the oil flow system. Said hollow pile may be installed by conventional methods such as drilling or blasting, or by torpedo pile (Brazilian Patent Application PI0106461), whereby said pile is raised a certain distance above the seabed then dropped so that it is driven into the bed by the force of the free fall. The oil flow passes through the pumping module, which is hydraulically linked to the producing well. Moreover, the present invention is constructed so that a pig (line-clearing device) can be passed through the flow lines. The pumping module is coupled to the base structure through a connector-mandrel assembly, with metal-metal sealing. Another advantage is the ease of removing the pumping module, using a vessel with a cable, with no need to disconnect the oil flow lines or any other component, thereby reducing the risk of an underwater oil spill. Such a system is described in the text and claims of the present application.

In the alternative configuration that employs this hollow pile, i.e., at a depth of tens of meters, the pumping module is fully or partially contained vertically in this hollow pile, and connected to the oil flow only by the IFI.

By means of a vessel fitted with a winch and cable, this configuration makes it easy to recover the pumping module to perform maintenance on the ESP assembly. Moreover, it is not necessary to use sophisticated vessels such as those outfitted with a rig, and facilitates the use of a longer motor-pump assembly.

In specific situations, the present invention eliminates the need to install an ESP at the bottom of the oil well; consequently, there is no need to work inside the oil well to remove the ESP, thereby substantially reducing production shutdown time (time spent awaiting a rig plus actual work time), as well as cutting costs.

Inasmuch as the ESP of the present invention is positioned outside the oil well, it can be installed or recovered with a cable from a non-specialized vessel, thereby substantially lowering the cost of maintaining the pump.

The system of the present invention also allows for the simultaneous installation of one pump inside and another outside the oil well, one being a backup for the other.

Whenever production or injection without the installed pumping module is desired, a closed cover can be installed on the IFI mandrel to ensure additional (double) blocking of the suction and discharge valves.

The present invention offers the following alternatives for oil production by subsea wells, with lifting through pumping:

by means of a pumping module alone, which can be installed and recovered by cable, with a production line from one or more wells coupled thereto; or by combining a pump installed at the well bottom and a pumping module, which can be installed and recovered by cable, with a production line from one or more wells coupled thereto. In the latter instance, the pumps will alternate operation, i.e., one pump is a backup for the other, with a subsea electrical switch allowing for remote operation (e.g., from the SPF—stationary processing facility).

The pump to be used in the pumping module in accordance with the present invention can be electrically driven (the preferred embodiment of the present invention) or hydraulically driven.

Furthermore, in accordance with the present invention, the pumping module allows for different types of pumps to be installed. Likewise, the use of electrically driven ESPs—similar to those normally installed at the bottom of oil wells—renders a more advantageous solution feasible, inasmuch as an economy of scale results from using standard manufactured equipment found throughout the oil industry.

The pumping module of the present invention has been developed with use of the ESP in mind, inasmuch as this pump is well known in the state of art as being similar to those installed at well bottoms. Likewise, there is nothing to prevent the development and installation of a more compact pump (not as thin), since by being outside the oil well its diameter can be larger and its height lower.

In a broader sense, the main object of the present invention is to build a pumping module linked to installation and recovery by cable whereby said module is coupled to a base structure that rests directly on the seabed or on a hollow pile, or even on a foundation comprising piles, with said base structure located at a safe distance from the WCT so that it does not interfere with well reentry operations. The pumping module and base structure are coupled through an intermediate flow inlet (IFI) that uses a connector with a metal-metal seal. The metal-metal seal must be used on subsea equipment that remains submerged for long periods of time at high pressures and in contact with corrosive substances generally found in oil.

Said base structure may simply rest on the seabed (similar to a skid), or it may be connected (coupled) to a foundation comprising piles, or can even be supported by and fully or partially inserted into a hollow pile, wherein said hollow pile is made especially for this purpose (in the preferred embodiment).

The pumping module is coupled to the base structure through an intermediate flow inlet comprising two on-off valves and one bypass valve. The base structure rests on the seabed and can be placed anywhere between the producing well and the SPF.

Said pumping module is a tubular structure wherein one or more motor-pump assemblies can be encased, including those of the ESP type. These pumping modules have a hydraulic connector whereby they can be connected to or disconnected from the IFI. If necessary, other components can be incorporated into this same pumping module, such as flowmeters, temperature gauges, pressure gauges, choke valves, and so forth.

In accordance with the present invention, this IFI comprises a cylindrical mandrel with at least two holes (cavities) for oil flow. One hole is interlinked with pump suction flow and the other with pump discharge flow. To render removal of the pumping module easier without causing an oil spill, two on-off valves are installed next to these mandrel holes. By shutting off these valves, suction and discharge flow can be hydraulically isolated, allowing for the pumping module to be installed or removed by cable with no risk of large underwater oil spills. A bypass valve is also installed for rerouting the flow from the pumping module, allowing production to continue whether or not the pumping module is installed and operating.

BRIEF DESCRIPTION OF THE DRAWINGS

The following descriptions of the embodiments of the present invention are examples only, and refer to the accompanying drawings. The same numerical references will be used in the attached figures for designating the same or similar parts.

Figure 8:
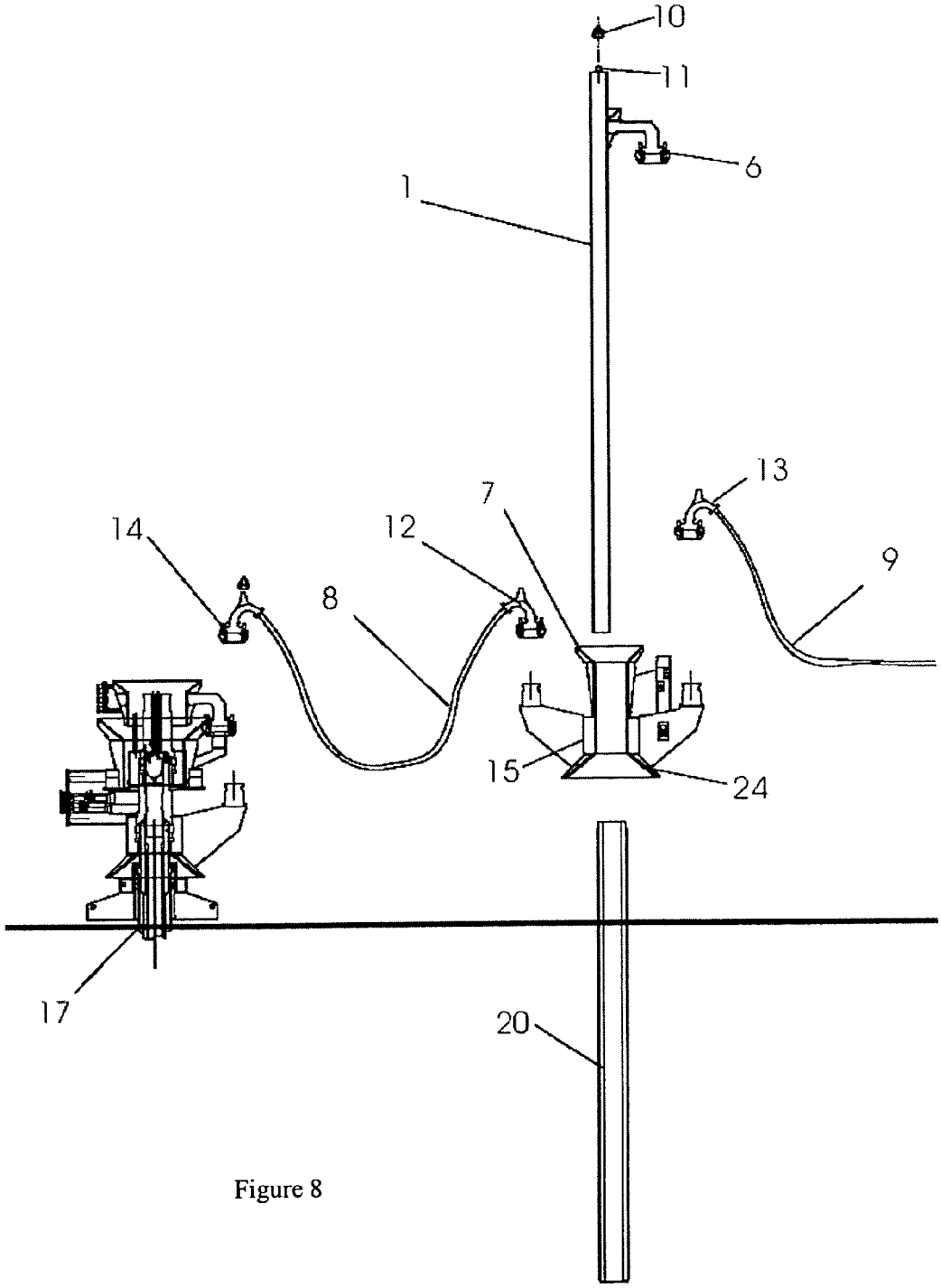
FIG. 8 is a schematic and simplified drawing of the pumping module installation method and steps, in the embodiment with the hollow pile, such being the preferred embodiment of the present invention.

It should be noted that the method for installing the pumping module with regard to the other embodiments of the present invention, i.e., with their base resting on the seabed and a pile, is very similar to the embodiment shown in FIG. 8, and accordingly will not be described in greater detail.

DETAILED DESCRIPTION OF THE PREFERRED EMBODIMENTS

Figure 1:
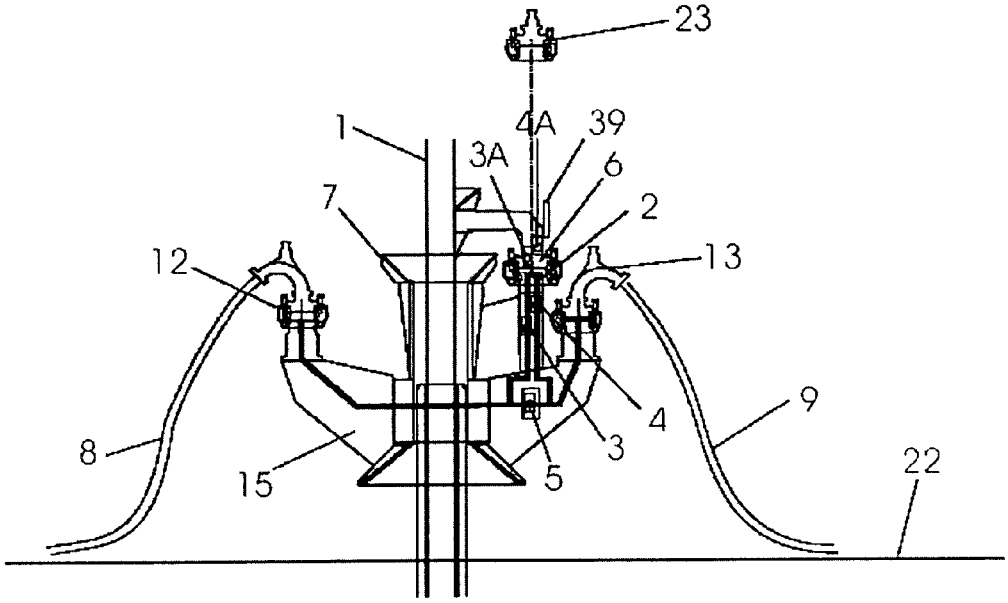
FIG. 1 shows the hydraulic plan of the Intermediate Flow Inlet (IFI) comprising the suction on-off valves and discharge on-off valves for the pumping module, flow bypass valve, and the mandrel for interconnection with the pumping module connector.

The following numbers apply to the description of the embodiments of the present invention:

1. pumping module
2. IFI mandrel
3. suction on-off valve
3A. suction on-off valve
4. discharge on-off valve
4A. discharge on-off valve
5. bypass valve
6. pump module connector
7. pumping module guide funnel
8. module upstream flow line
9. module downstream flow line
10. pumping module installation tool
11. pumping module neck
12. VCM—suction
13. VCM—discharge
14. WCT VCM
15. base structure
17. subsea wellhead
18. wet Christmas tree (WCT)
19. production adaptor base (PAB)
20. hollow pile driven into seabed
21. pile
22. seabed
23. closed cover
24. base guide funnel
29. seal protector
30. pump motor
31. pump
32. pumping module flow inlet
33. pumping module flow outlet
34. pump support
35. mechanical synchronizer
36. pump casing
37. wet electrical connector
38. electrical cable
39. ROV [remote operated vehicle] interface panel
40. motor electrical terminals
41. electrical penetrator
42. flat electrical cable The following numbers apply to the description of the embodiments of the present invention:

The figures, particularly FIG. 1, illustrate a pumping module system coupled to an intermediate flow inlet (IFI). More specifically, a connector 6 for a pumping module 1 is coupled to a mandrel 2 of the intermediate flow inlet IFI. This pumping module 1 can be installed either horizontally or vertically (the latter being the preferred position of the present invention). The connector 6 that couples the pumping module 1 to the mandrel 2 of the IFI has a metal-metal seal that provides a seal between the connector 6 and the mandrel 2.

A base 15 of the pumping module 1 is interlinked with flow lines by means of devices known as vertical connection modules (VCM), well known in the present state of art. The inlet VCM 12 that receives well production is interlinked with the suction flow from the pumping module pump through a tube wherein a suction on-off valve 3 is installed. Pump discharge is interlinked to the outlet VCM 13 through a tube wherein a discharge on-off valve 4 is installed. A bypass valve 5 allows flow from the module to be rerouted while a pig (a line-clearing device) is passed through whenever necessary. As such, the present invention is built in such a way whereby a pig can be passed through the system when the flow bypasses the mandrel 2 and pumping module 1.

More specifically, said mandrel 2 has an outlet hole and a return hole, whereby a production flow line 8 coming from a well is shunted through the mandrel outlet hole to the pumping module 1. After the oil flow circulates, and accumulates energy (and pressure), in the pumping module 1, the oil flow returns to the mandrel 2 through the return hole, with this flow finally routed through a flow line 9 that interlinks with a processing facility (not shown).

In contrast, for a water injector well, the suction flow and discharge flow are reversed, i.e., the suction flow is fed by the flow line 9 coming from the FPU 1 [flow production unit] and the discharge is interlinked with the flow line 8, which is coupled to a well 17.

When pumping module 1 is not installed, a closed cover 23 is mounted on mandrel 2 for the sole purpose of establishing a second hydraulic barrier to avoid spills into the sea. Two off-on valves, for suction 3A and discharge 4A, should also be installed on the pumping module 1, in addition to the valves 3 and 4 on the mandrel. These valves 3A, 4A block oil leaks from the pumping module 1 while the pumping module 1 is being removed.

With further reference to FIG. 1, although the flow line 8 is represented as a flexible line, when the distance between the oil well and the base is short, this interlinking can also be made from rigid rather than flexible tubing.

Also in accordance with the present invention, the pumping module 1 can be installed and operated separately or associated with another ESP installed at the well bottom. In this case, pumps will be redundant and will operate in an alternating fashion. This concept extends production because the pumping system does not have to shut down to repair the ESP installed at the well bottom, since if one assembly fails, the other can be immediately actuated by remote control using an electrohydraulic switch (not shown) coupled to the WCT. Said electrical switch can be mounted on the WCT or can also be incorporated into the pumping module 1 or the base 15.

With further reference to FIG. 1, an interface panel 39 for an Remote Operated Vehicle (ROV) is shown. Although the interface panel 39 is not shown in the subsequent Figures, the ROV is a feature of the arrangements given in subsequent Figures. Said interface panel 39 has interfaces for ROV driving that include the following functions:

Interlocking and unlocking of the connector 6

Testing of a seal for the connector 6

Receptacle for wet electrical connector 37 for feeding pumping module 1.

As detailed in FIGS. 5 and 6, the electrical connector 37 and electrical penetrator 41 are interlinked by a short electrical cable 38. There is a flat electrical cable 42 between the penetrator 41 and motor electrical terminals 40. The motor is linked to the pump 31 through a seal protector 29, all of these components being well known and in the public domain.

Figure 2:
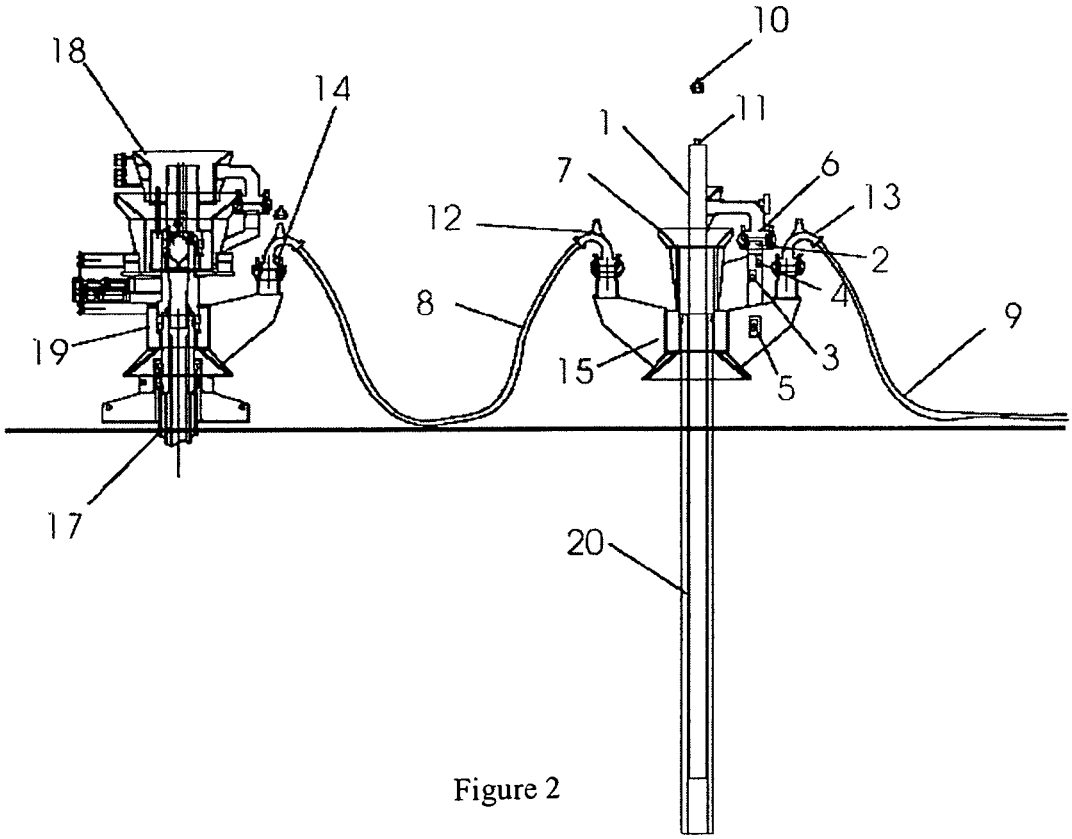
FIG. 2 shows an embodiment wherein the pumping module in accordance with the present invention is installed inside a hollow pile in the seabed.

FIG. 2 is a schematic drawing of the embodiment wherein the pumping module 1, in accordance with the present invention, is installed inside a hollow pile 20. In this configuration, the connector 6 is located to one side of the pumping module 1 and is joined to the mandrel 2 of the base 15 of the pumping module 1. The base 15 of the pumping module 1 is supported and joined to the hollow pile 20. A steel funnel 7 has been installed to facilitate reentry and the positioning of the pumping module 1.

When the pumping module 1 is installed vertically, there is a neck type profile 11 at the upper end of the pumping module for connecting a cable installation tool 10 The tool 10 is driven by the ROV. Although the tool 10 is not shown in the subsequent figures, the installation of the neck 11 also pertains to the other embodiments and will not be described again with respect to the remaining Figures.

FIG. 2 also shows a wellhead 17, a production base 19 and a WCT 18. This Figure is intended solely to illustrate the interface of the present invention with other subsea equipment.

Figure 3:
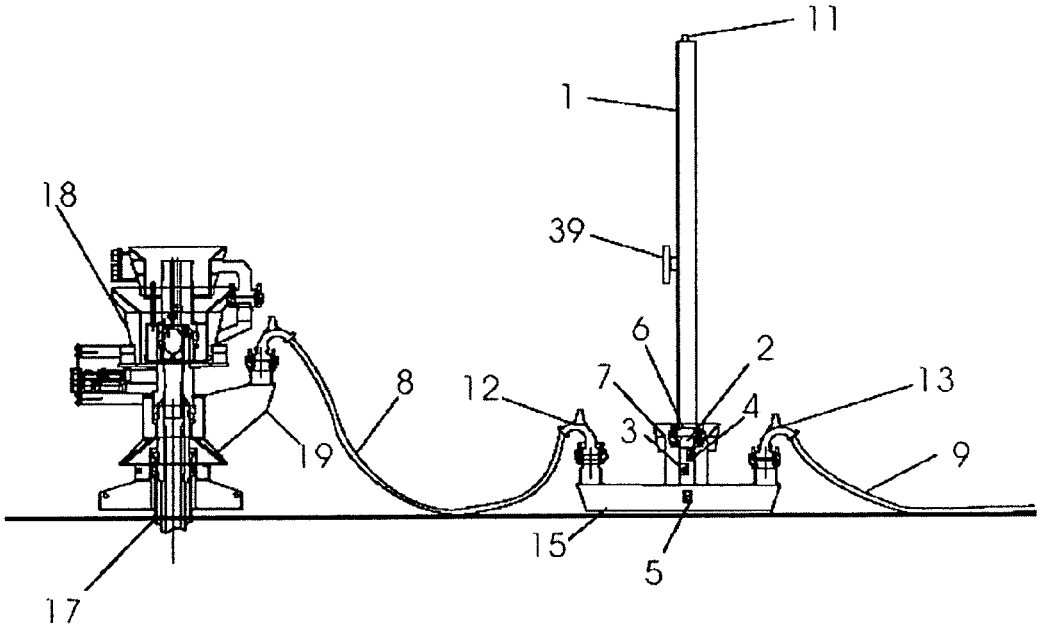
FIG. 3 shows an embodiment wherein the pumping module in accordance with the present invention is installed on a base (skid) resting directly on the seabed.

FIG. 3 shows a pumping module 1 coupled to the base 15 of the pumping module 1. In this embodiment, the base 15 rests directly on the seabed. In this configuration, the connector 6 is located at the lower end of the pumping module 1.

Figure 4:
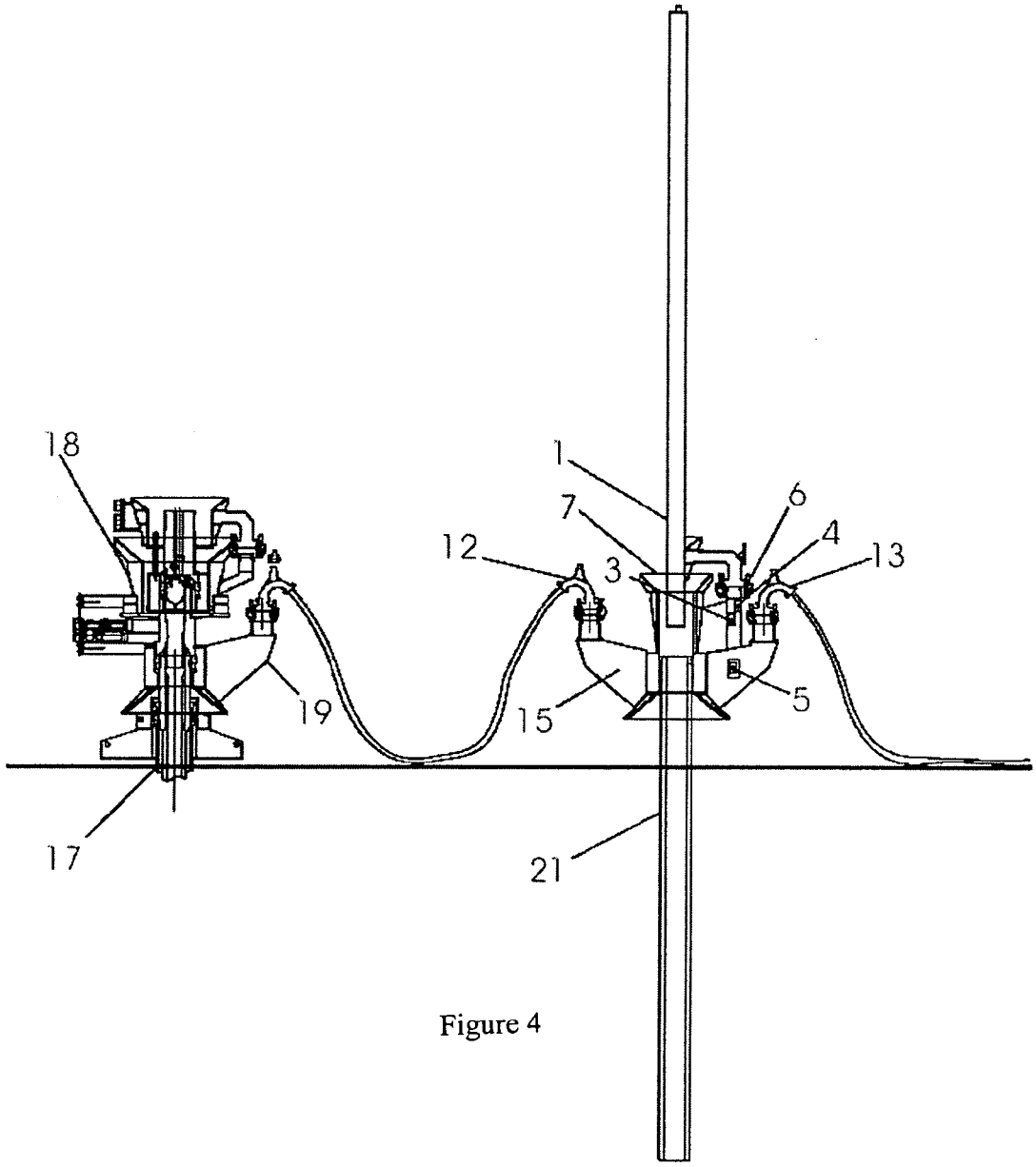
FIG. 4 shows an embodiment wherein the pumping module in accordance with the present invention is installed on a base which is in turn supported by and mounted on a pile driven into the seabed.

FIG. 4 is a schematic diagram of the embodiment whereby the pumping module 1 in accordance with the present invention is installed coupled to a base 15, which in turn is coupled to a foundation comprised of a pile 21.

Figure 5A:
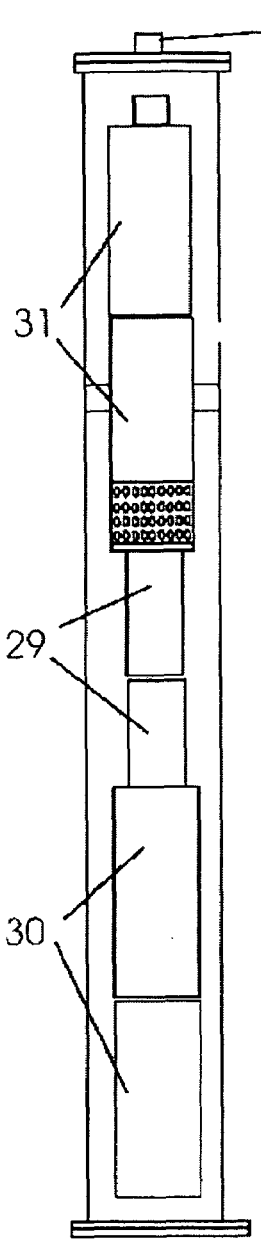
FIG. 5A shows one of the possible arrangements inside the pumping module with a single motor-pump assembly comprising two motors, two protectors and two pumps, all linked along the same geometrical axis.

FIG. 5A shows one possible arrangement of the inside of the pumping module 1. A single motor-pump assembly comprising two motors 30, two seal protectors 29 and two pumps 31, all linked along the same geometrical axis.

Figure 5B:
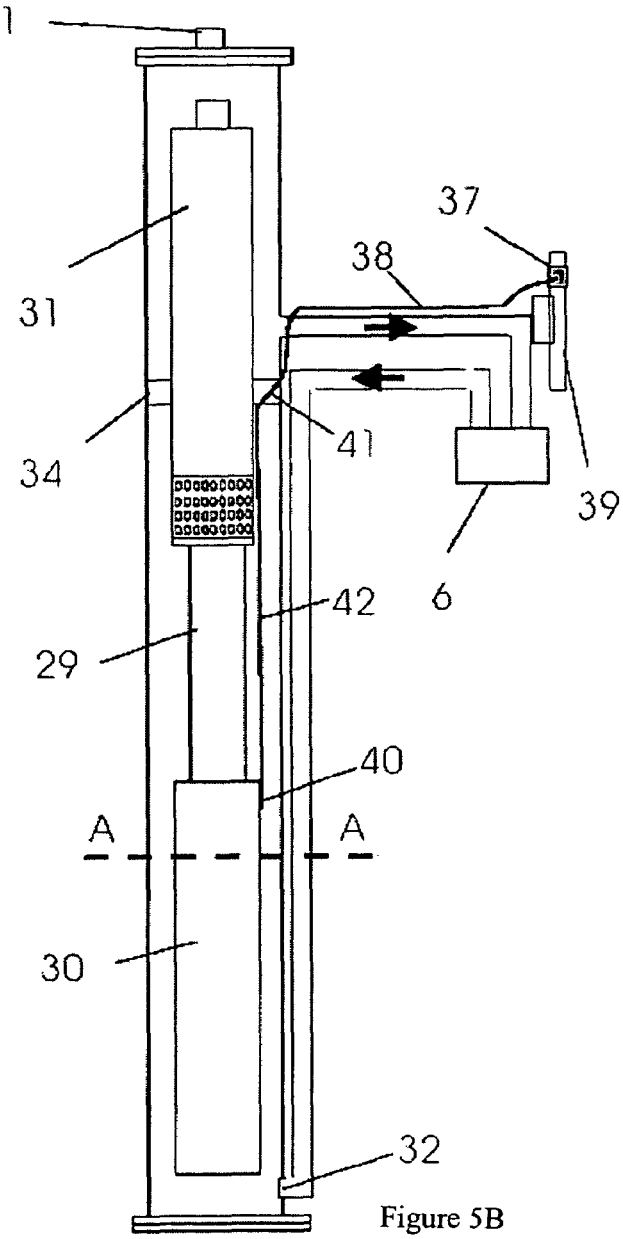
FIG. 5B shows one of the possible arrangements inside the pumping module with a single motor-pump assembly, and with details of a possible arrangement of the incoming and outgoing tubing.

FIG. 5B shows another possible arrangement inside the pumping module 1, including a single motor-pump assembly and a possible arrangement of the incoming and outgoing tubing.

Figure 5C:
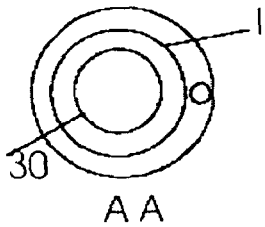
FIG. 5C shows section A-A from FIG. 5B in detail, illustrating the position of the module and the respective incoming flow tubing.

FIG. 5C shows section A-A from FIG. 5B in detail, illustrating the position of the module 11 and the respective incoming flow tubing.

With current techniques known in the art, ESP applications often require high-flow and high-head (i.e., pressure differential supplied by pump) equipment. However, due to pump construction limitations in geometry whereby there is a small diameter and a long length due to the thin geometry of the oil well, at times these ESP assemblies are mounted with two motors, two protectors and two pumps, all coupled along the same geometrical axis. This type of mounting is performed in order to impart specific flow and head characteristics to the assembly.

In the present invention, because the ESP is installed outside the well; there are no similar geometrical restrictions. However, for economy it is recommended that an ESP of standard manufacture be used.

The present invention suggests that such ESPs be installed inside subsea pumping modules 1. To facilitate the installation and recovery of such modules, preference is given to a geometry with a short length so as to make handling of the module on the vessel and mounting of the module in land-based shops easier.

To circumvent such limitations, according to one embodiment of the present invention, the two motor-pump assemblies are installed on parallel geometrical axes in order to shorten the overall length of the module by around half. This design that can be best visualized in FIGS. 6 and 7.

FIGS. 6A-6D shows some of the various possible arrangements of the interior of the pumping module for two motor-pump assemblies 30, 31 inside the module, hydraulically interlinked in series, i.e., the flow entering the pumping module 1 through the inlet 32, after passing through the first pump, is routed to suction flow of the second pump and then to the outlet 33. One limit posed by this design is that one of the assemblies works upside down, i.e., with its head downward, a position not foreseen in the ESP design and which could result in the premature failure of certain of its components.

The pumping assembly of the motor 30 and pump 31 is supported inside the pumping module 1 by the pump support 34.

Figure 6A:
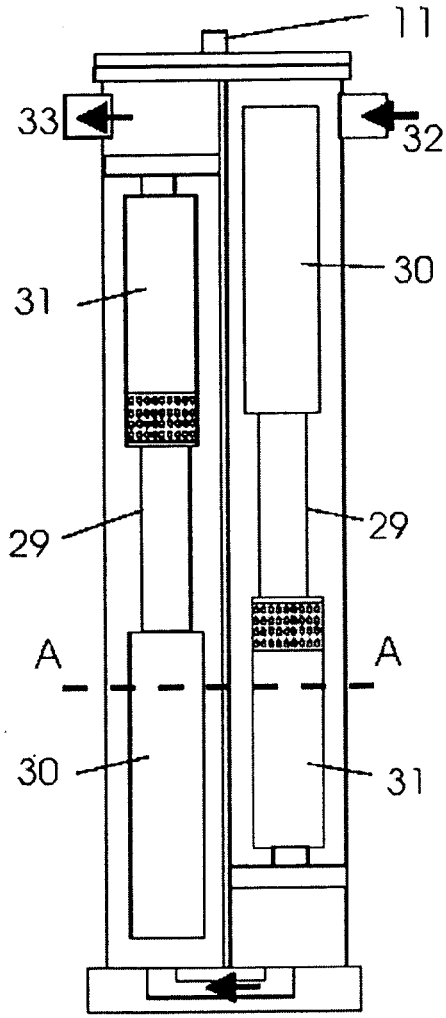
FIG. 6A shows one of the various possible arrangements of the inside of the pumping module with two motor-pump assemblies hydraulically interlinked in series, each in its own casing.

In FIG. 6A each pumping assembly is located inside its own tube (casing) 36, i.e., the pumps are installed in two casings of the same diameter, one for each pump.

Figure 6B:
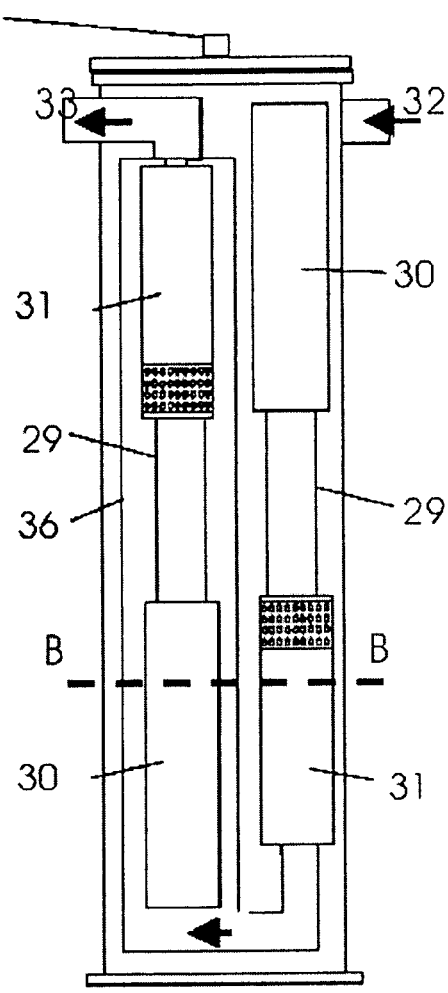
FIG. 6B shows one of the various possible arrangements of the inside of the pumping module with two motor-pump assemblies hydraulically interlinked in series inside of concentric casings, i.e., one inside the other.

FIG. 6B shows a design wherein a casing inside the pumping module contains only one motor-pump assembly.

Figure 6C:
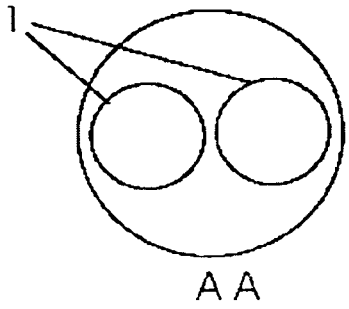
FIG. 6C shows Section A-A from FIG. 6A in detail, illustrating the relative position of the two assemblies in parallel.
Figure 6D:
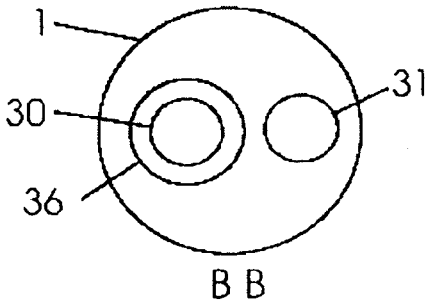
FIG. 6D shows Section B-B from FIG. 6B in detail, illustrating the relative position of the two assemblies in parallel.

FIGS. 6C and 6D show sections A-A and B-B, respectively, wherein the relative position of the motor-pump assemblies can be seen.

Figure 7A:
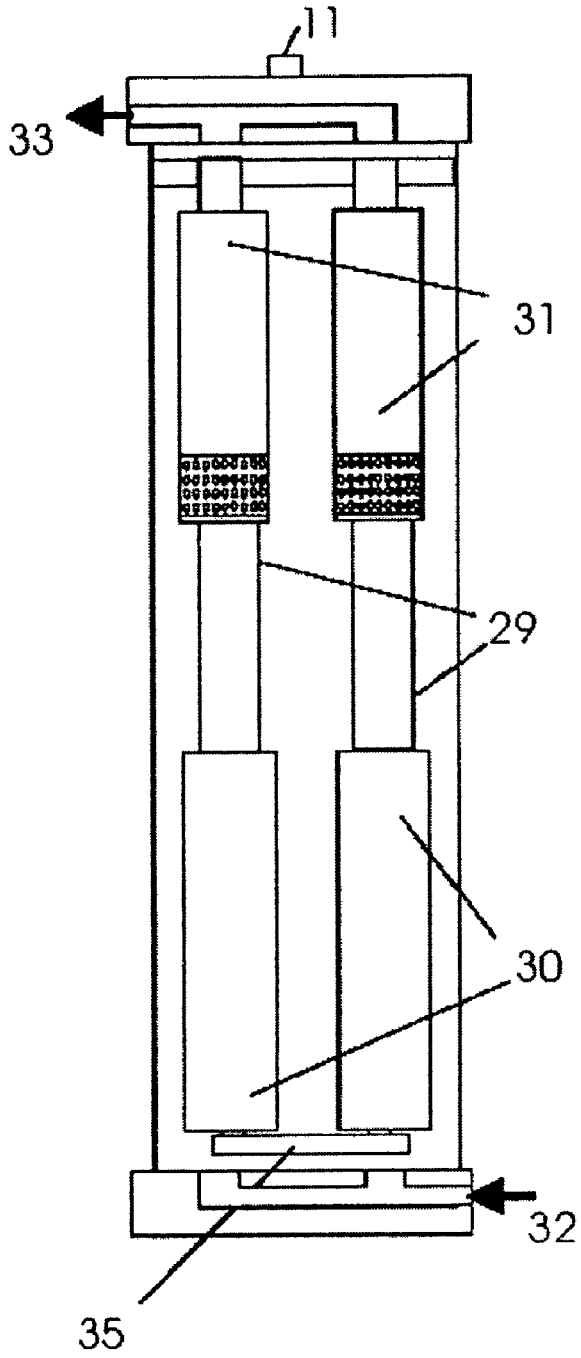
FIG. 7A shows one of the various possible arrangements of the inside of the pumping module for two motor-pump assemblies inside the module, hydraulically interlinked in parallel, and with the shafts of the motors coupled through a box whereby they are mechanically synchronized.
Figure 7B:
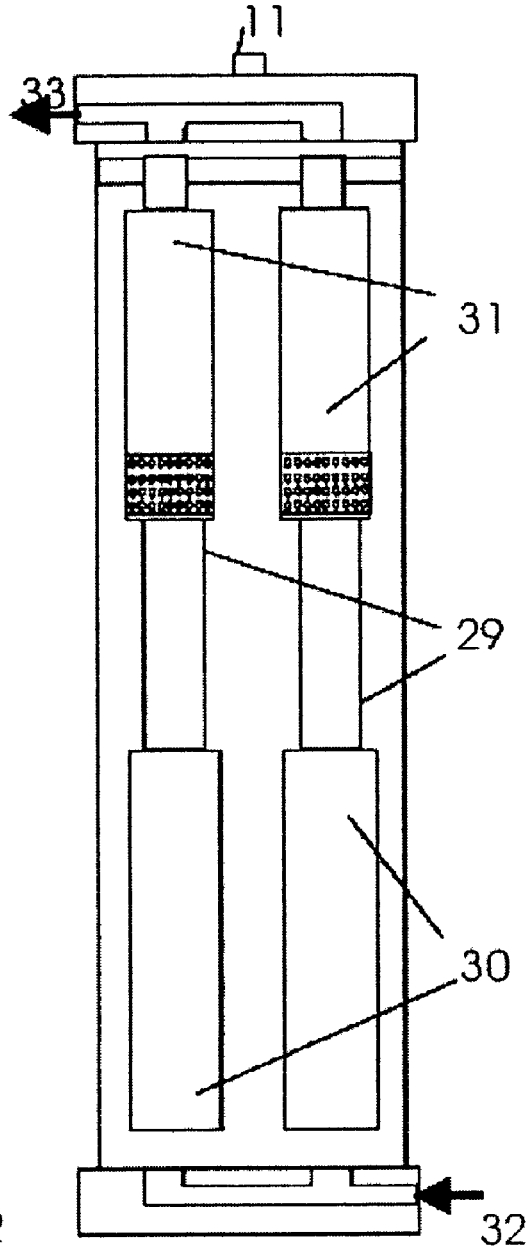
FIG. 7B shows one of the various possible arrangements of the inside of the pumping module for two motor-pump assemblies inside the module, hydraulically interlinked in parallel, with no synchronizing device between the shafts.

FIGS. 7A and 7B show other possible arrangements of the inside of the pumping module 1 for two motor-pump assemblies inside the pumping module 1 in which the motor-pump assemblies are hydraulically interlinked in parallel, i.e., with flow entering the pumping module 1 through inlet 32 and simultaneously routed to the suction flow of the two pumps and the outlet flow simultaneously routed to a single outlet 33 on the pumping module 1. Also, FIG. 7A shows a mechanical synchronization device 35 which may comprise a gear box or other similar device for linking the shafts in order to maintain mechanical synchronism. This device serves to reduce the risk from using a single power cable to feed both electric motors. The sole difference between FIGS. 7A and 7B is precisely the mechanical synchronization device 35.

Although the pump motor 30 is shown in the Figures, the pump motor 30 can also be located outside the pumping module in direct contact with the sea water. Whenever the pumping module 1 is lowered and installed horizontally, the neck 11 can be positioned close to the middle of the pumping module 1 and its center of gravity. The pumping module 1 can also be lowered vertically to the bottom, rotated 90 degrees from a support point on the base 15, and then installed horizontally.

Use of the present invention also makes it possible to install two ESPs, one at the bottom of the well and the other on the seabed, and which may operate simultaneously (jointly) or alternatingly, with one serving as a backup for the other in the latter instance.

System Installation Method

FIG. 8 is a schematic diagram of the installation sequence for the pumping module system in the embodiment with the hollow pile 20.

The installation steps of the present invention will be described for the embodiment with the hollow pile 20. The installation method of the other embodiments, with the base 15 resting directly on the seabed and the base 15 resting on the foundation comprising a pile 21, will not be described in detail. However, the installations of these embodiments are very similar to the embodiment with the hollow pile and are considered readily apparent to one skilled in the art.

First, a hollow pile 20 is driven (buried) in the sea bed. The inside diameter of the pile is greater than the outside diameter of the pumping module 1. Various techniques can be used to drive in the hollow pile 20, including free fall (similar to the torpedo pile), suction (similar to suction anchoring), blasting (a technique similar to that used to start a subsea well), or simply by drilling with a bit. All of these techniques are well known and mastered in the current state of the art.

If blasting or simple drilling is selected, the hollow pile can be lowered with the base 15 of the pumping module 1 previously connected thereto, saving work time required to lower the base 15 by itself.

After driving in the hollow pile 20, of a length from 15 to 40 meters, and depending on the dimensions of the pumping module 1, a length of around 2 to 5 meters should be left unburied. The function of the unburied portion is mainly to guide and support the base 15 of the pumping module 1.

Next, the base 15 is lowered. The base has a downward-facing funnel 24, which guides the insertion of the hollow pile 20 into the base. Next, the base 15 is attached to the hollow pile 20. Different mechanisms can be employed to make this attachment, including a low-pressure (1500 psi) housing device, or a J slot type system, both of which are well known and used in drilling bases.

After the base 15 of the pumping module 1 has been installed and connected to the hollow pile 20, the flexible lines 8, 9, along with the pumping module 1, are then mounted to the base 15 in any sequence.

The pumping module 1 is lowered until it is fully supported by a shoulder on the base 15. The pumping module 1 is then connected to the mandrel 2 of the base 15 by the connector 6.

The flexible lines 8, 9 are coupled from vertical control modules 12, 13, 14. Depending on the vessel and facilities employed, VCM 12 and its respective base mandrel 15, may not be needed. Instead, a pair of surface-mounted flanges are installed prior to placing the base 15 in the water. In this case, the base 15 can be lowered along with the flexible line 8 mounted on said base 15.

Although the present invention has been described in terms of its preferred embodiments, it is obvious to one skilled in the art that various changes and modifications are possible without departing from the scope of the present invention as set forth in the attached claims.

What is claimed is:

1. A subsea pumping module system, comprising:

a pumping module base that is one of:

a structure resting on a seabed wherein a removable pumping module is vertically or horizontally mounted on said pumping module base, a structure coupled to a hollow pile driven into the seabed, wherein the pumping module is vertically inserted within said pile, and a structure resting on and connected to a pile wherein the pumping module is vertically or horizontally mounted on said pile;

an Intermediate Flow Inlet (IFI) including a cylindrical mandrel, wherein said mandrel includes an outlet hole, a return hole, a first on-off valve for the outlet hole, a second on-off valve for said return hole, and a pumping module bypass valve interlinked upstream from the first on-off valve and downstream from the second on-off valve;

a production line shunted to a suction flow of the pumping module through the outlet hole of said mandrel, wherein after circulating in the pumping module the flow returns to the mandrel through the return hole, a flow line, wherein said flow is routed from said mandrel through the flow line;

the pumping module including a closed tubular body to which a hydraulic connector is coupled, wherein said connector is coupled to the mandrel in order to establish a hydraulic contact between the pumping module and the outlet and return holes on said mandrel, wherein a connector seal of the metal-metal type is provided at a coupling between said connector and said mandrel; and wherein said pumping module includes a mechanical profile that serves as an interface with a tool for cable installation and recovery of the pumping module.

2. The system of claim 1, wherein the production line comes from one or more wells and the flow line is connected to a processing facility.

3. The system of claim 2, wherein said one or more wells are oil producing wells.

4. The system of claim 1 wherein the pumping module is installed and recovered by cable from a vessel.

5. The system of claim 1, wherein said pumping module includes an on-off suction valve and an on-off discharge valve for preventing oil found in the module from leaking from the pumping module when the pumping module is removed.

6. The system of claim 1 wherein the pumping module further includes an encased pump and electric motor.

7. The system of claim 1 wherein at least one motor-pump assembly is installed inside the pumping module.

8. The system of claim 7, wherein least one motor-pump assembly includes more than one motor linked in series, in parallel, or a combination of both, and wherein the hydraulic connector includes more than connector provided in series, a in parallel, or a combination of both.

9. The system of claim 1, further comprising an electric submersible pump, said electric submersible pump being similar to pumps used at the bottom of oil wells.

10. The system of claim 2, wherein said one or more wells includes multiple producing wells interlinked at a pumping module inlet and the return for this pumping module interlinked to the production line carrying the oil flow to the processing facility.

11. The system of claim 1 wherein the production line is connected to a processing facility and the flow line is connected to one or more injector wells.

12. The system of claim 1, wherein said pumping module can be lowered in the vertical position using a guiding and turning system in the pumping module base where the IFI is located, thus allowing the module to be installed horizontally.

13. The system of claim 1, further comprising a closed cover that can be installed or recovered by a cable coupled to the IFI, wherein said cover provides a double blockage when the pumping module is not installed, and wherein a closed cover connector seal is of the metal-metal type.

14. The system of claim 1, further comprising a second electrical submersible pump provided at the bottom of a well, so that both said pump module and said submersible pump can operate simultaneously or alternatingly by using an electrical switch installed in a wet Christmas tree or on the pumping module itself.

15. The system of claim 1, wherein more than one pumping module is installed on the base to allow for simultaneous or alternating operation of said modules by using an electrical switch installed in subsea equipment close to or on the pumping module.

16. The system of claim 1, wherein said pumping module includes two or more motor-pump assemblies arranged side by side and hydraulically linked in parallel or in series.

17. The system of claim 1 wherein the pumping module includes two motor-pump assemblies arranged side by side and hydraulically linked in parallel and synchronized by a mechanical device so that said device coupled to shafts of the two motors maintains rotary synchronism between said two shafts.

18. The system of claim 1 wherein said pumping module bypass valve on said IFI allows a pig to be passed through the system whenever necessary.

19. A method for installing a subsea pumping module comprising the following steps:

a) driving a hollow pile into the seabed by any of the following methods: drilling, blasting, torpedo pile, or a combination thereof;

b) leaving a portion of said hollow pile unburied so that it can guide and support the base of the pumping module;

c) lowering a base of the pumping module fitted with a downward-facing funnel that guides the insertion of the hollow pile into said base;

d) employing a remote operated vehicle (ROV) to attach the base to the hollow pile;

e) mounting flexible lines to said base;

f) lowering the pumping module until it is resting fully on the base; and g) employing the ROV to attach the pumping module to the base mandrel using the connector.

20. The method of claim 19, wherein the hollow pile can be lowered with the base of the pumping module previously connected thereto.

21. A method for installing a subsea pumping module comprising the following steps:

a) building a foundation by driving a pile into the seabed by any of the following methods: drilling, blasting, torpedo pile, or a combination thereof;

b) leaving a portion of said hollow pile unburied so that it can guide and support the base of the pumping module, said base fitted with a downward-facing funnel that will serve to guide the insertion of the end of the pile into said base;

c) lowering by cable the base;

d) employing a remote operated vehicle (ROV) to attach the base to the pile;

e) mounting flexible lines and pumping module to said base;

f) lowering the pumping module until it is resting fully on the base;

g) lowering the flexible lines and connecting them to their respective mandrels;

h) employing the ROV to attach the pumping module to the base mandrel using the connector.

22. A method for installing a subsea pumping module comprising the following steps:

a) lowering by cable a base fitted with a downward-facing funnel that will serve to guide insertion of an end of a pile into said base;

b) mounting flexible lines and the pumping module on the base;

c) lowering the pumping module until it is resting fully on the base;

d) employing a remote operated vehicle (ROV) to attach the pumping module to the base using a connector;

e) lowering the flexible lines and connecting them to respective potions of the base.

23. The system of claim 5, wherein said pumping module further includes at least one of a flowmeter, a flow control valve, an electrical switch, and a control module.

24. The system of claim 1, wherein said base further includes a funnel mounted on the base, said funnel facilitating positioning of the pumping module.

* * * * *